United States Patent [19]

Schnurr et al.

[11] 4,132,214

[45] Jan. 2, 1979

[54] BALL DELIVERY APPARATUS

[76] Inventors: Myron J. Schnurr, 12560 Havelock Ave., Los Angeles, Calif. 90066; Alvin D. Schnurr, 23428 Sidlee Pl., Harbor City, Calif. 90710; Marian Schnurr, 12560 Havelock Ave., Los Angeles, Calif. 90066

[21] Appl. No.: 789,258

[22] Filed: Apr. 20, 1977

Related U.S. Application Data

[63] Continuation-in-part of Ser. No. 638,057, Dec. 5, 1975, abandoned.

[51] Int. Cl.[2] ..... F41B 15/00

[52] U.S. Cl. ..... 124/1; 124/50; 273/29 A

[58] Field of Search ..... 124/50, 49, 41 R, 7, 124/8, 6, 1; 273/26 D, 26 R, 29 R, 29 A; 221/21, 22, 268, 295, 255; 222/500, 508; 226/10; 259/2; 46/43, 42

[56] References Cited

U.S. PATENT DOCUMENTS

| | | | |
|---|---|---|---|
| Re. 16,791 | 11/1927 | Hawk | 46/42 |
| 1,244,457 | 10/1917 | Bain | 46/42 |
| 1,260,664 | 5/1918 | Gregory | 46/43 |
| 1,317,184 | 9/1919 | Voss | 46/42 |
| 2,400,410 | 5/1946 | Hatcher | 46/43 |
| 2,941,643 | 6/1960 | Donnelly | 221/295 X |
| 3,252,453 | 5/1966 | Giovagnoli | 124/50 X |
| 3,511,225 | 5/1970 | Yokoi | 124/7 |
| 3,570,171 | 3/1971 | Shook | 46/42 |

*Primary Examiner*—Richard C. Pinkham
*Assistant Examiner*—William R. Browne
*Attorney, Agent, or Firm*—Paul M. Coble

[57] ABSTRACT

Apparatus for delivering a plurality of balls one after another with spacing therebetween to a desired location for use by a player. The apparatus includes a support mounted on a surface which may be vertically adjustable and a gravity feed ball supply for permitting a plurality of balls to feed by gravity onto the playing surface. A gate is provided which retains one ball in position until another is released. The apparatus may include a movable member which is connected to the gate and down which a ball moves under gravity. When the ball is discharged onto the playing surface after it leaves the movable member, a counterweight also connected to the gate restores both the gate and the movable member to a position whereby the gate releases a subsequent ball while the movable member assists in blocking more than one ball from moving past the gate. The combined weight of the released ball and the movable member, as the released ball moves down the movable member, overcomes the weight of the counterweight thereby discharging a ball under gravity onto the playing surface. The speed and timing of the balls may be varied. The cycling of the discharged balls is repeated until all of the balls in the ball supply are discharged.

7 Claims, 11 Drawing Figures

BALL DELIVERY APPARATUS

RELATIONSHIP TO PENDING APPLICATION

This application is a continuation-in-part of application Ser. No. 638,057, filed Dec. 5, 1975, now abandoned.

BACKGROUND OF THE INVENTION

1. Field of the Invention

The invention relates to ball delivery apparatus; and, more particularly, to apparatus for automatically delivering a plurality of balls, such as a tennis ball or ping pong ball or the like, one after the other, to a desired location without the need for complicated and expensive equipment.

2. Description of the Prior Art

There has always been an interest in certain sports, such as baseball, tennis, table tennis, etc. In recent years, however, more and more people have been exercising by participating in certain sports, such as tennis. In order to become proficient in these sports, it is desirable to practice certain movements. For example, in tennis, one likes to improve his return of the ball, his backhand, forehand, etc. It is not always possible to have a fellow player participate with the player to deliver balls to him for return. Further, such an additional player would not be able to repetitively deliver a plurality of balls, one after another, at a desired location for stroke by the player. Although certain machines have been suggested for delivering a plurality of balls, one after another, to a desired location for use by a player, such prior art machines are generally complex and expensive and/or require a source of electricity to operate. There is thus a need for an inexpensive and portable practice machine which can deliver a plurality of balls, one after another, to a desired location for stroke by a player, such as in tennis, table tennis, baseball, etc.

SUMMARY OF THE INVENTION

It is an object of this invention to provide apparatus for delivering a plurality of balls, one after another, to a desired location.

It is a further object of this invention to carry out the foregoing in an inexpensive manner requiring no external motive power.

It is a still further object of this invention to deliver balls in a manner whereby the slope of descent of the balls may be adjusted so that the delivery of the balls may be varied.

It is still another object of this invention to deliver balls in a manner whereby the speed of the balls may be slowed down prior to delivery.

These and other objects are preferably accomplished by providing a support mounted on a surface which may be vertically adjustable and a gravity feed ball supply for permitting a plurality of balls to feed by gravity onto the playing surface. A gate is provided which retains one ball in position until another is released. The apparatus may include a movable member which is connected to the gate and down which a ball moves under gravity. When the ball is discharged onto the playing surface after it leaves the movable member, a counterweight also connected to the gate restores both the gate and the movable member to a position whereby the gate releases a subsequent ball while the movable member assists in blocking more than one ball from moving past the gate. The combined weight of the released ball and the movable member, as the released ball moves down the movable member, overcomes the weight of the counterweight thereby discharging a ball under gravity onto the playing surface. The speed and timing of the balls may be varied. The cycling of the discharged ball is repeated until all of the balls in the ball supply are discharged.

DESCRIPTION OF THE PREFERRED EMBODIMENTS

Figure 1:
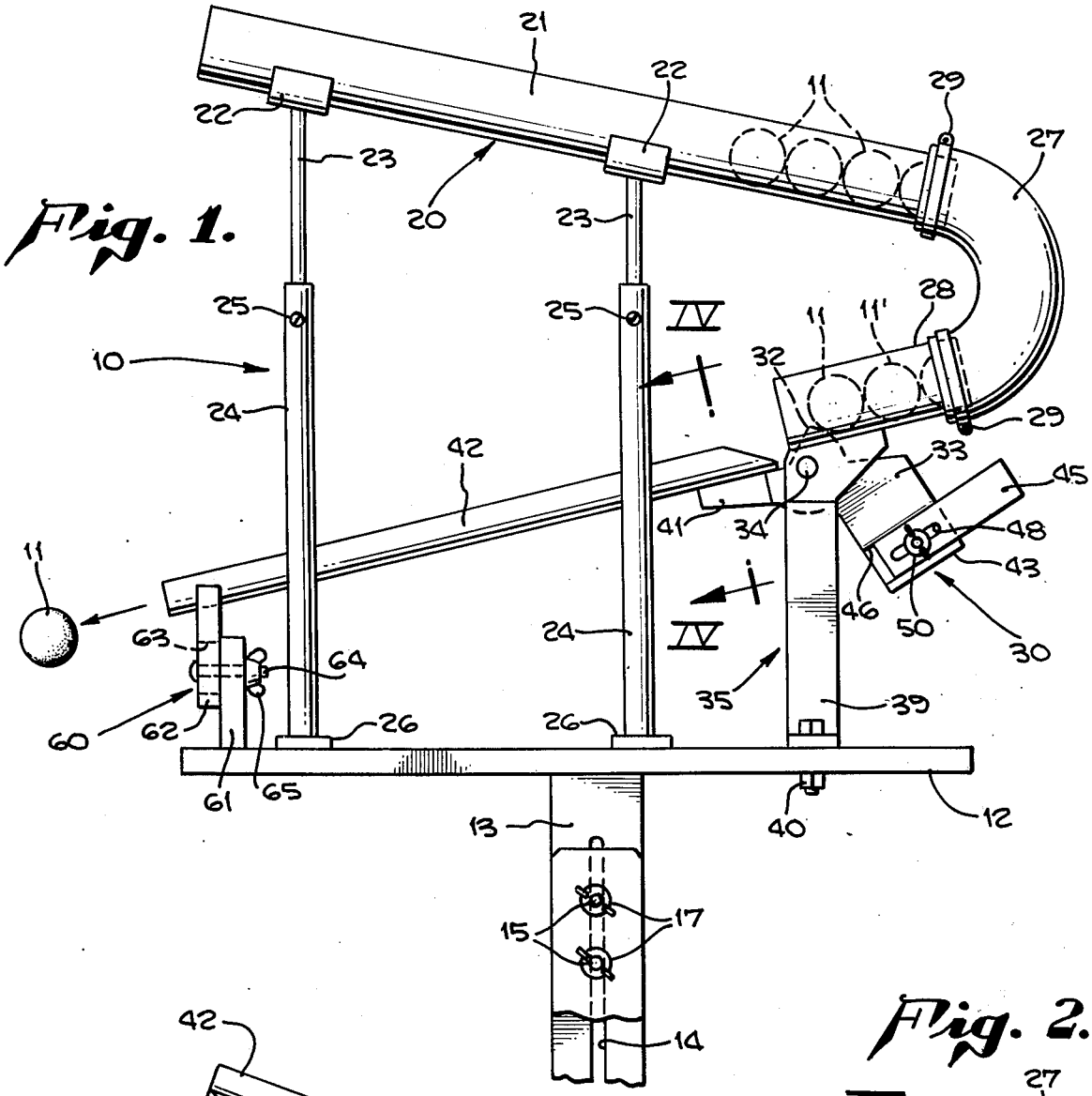
FIG. 1 is a vertical view of apparatus in accordance with the teachings of the invention.

Referring now to FIG. 1 of the drawing, apparatus 10 is shown which is adapted to convey a plurality of balls, one after another, to a desired location for striking by a player. For example, as shown in FIG. 1, ball 11 may be delivered via apparatus 10 to a position adjacent a tennis player whereby ball 11 bounces on a surface and is struck by the player on its rebound. Of course, as will be discussed, the path of delivery of ball 11 may be adjusted depending on the use to which apparatus 10 is put. For example, ball 11 may be delivered at a point sufficiently high to be struck by a batter with a baseball bat or the like.

Thus, FIG. 1 includes a main base portion 12 having a downwardly extending support post 13 fixedly secured thereto. Post 13 may have an elongated slot 14 for receiving adjusting screws 15 therethrough. These screws 15 pass through suitable apertures in a mating post 16 which, at its lowermost end, is fixedly secured to a supporting base (not shown) adapted to rest on a playing surface, such as a tennis court. Wing nuts 17 are threaded on screws 15 to thereby fixedly and adjustably secure post 16 to post 13. In this manner the overall height of apparatus 10 is vertically adjusted.

As particularly contemplated in the present invention, gravity feed ball supply means 20 are provided for supplying a plurality of balls for delivery by apparatus 10; ball retention and gravity feed discharge means 30 are provided for retaining one ball until another is released so that one ball is delivered after another with a preset interval between delivery; and limiting means 60 are provided for limiting the slope or downward extent of the means 30.

Thus, in the exemplary embodiment of the invention, ball supply means 20 preferably includes a ball delivery tube 21 supported by one or more spaced curved supports 22 fixedly secured to shafts 23. These shafts 23 are telescoped in posts 24 and adjustably and fixedly secured thereto by set screws 25. Posts 24 depend vertically upwardly from base portion 12 and may be fixedly secured thereto by base plates 26. As can be seen in FIG. 1, the heights of each shaft 23 may be adjusted to provide a desired slope to tube 21 so that balls 11, in tube 21, move by gravity down tube 21. Ball supply means 20 further includes an elbow portion 27 clamped at one end to tube 21 and at the other end to a ball outlet. Clamps 29 may be used to secure elbow portion 27 to tube 21 and outlet 28. Also, elbow portion 27 may be of a suitable resilient material, or a light-weight material, such as plastic. In any event, the internal diameters of tube 21, elbow portion 27 and outlet 28 are generally substantially the same without any internal obstructions so that balls 21 may move by gravity from tube 21 to outlet 28.

Also, an additional feature of the invention is that, in certain sports such as tennis, tubes of a fairly standard design and diameter are used to pick up balls that have been played. Since tube 21 need not be permanently secured to supports 22 (or may be easily removably secured thereto) and clamps 29 are removably adjustable, tube 21 may be similar in outer diameter to the aforementioned tubes used to pick up already played balls; thus, tube 21 could be removed, used to pick up such balls, then locked in position as shown in FIG. 1. Alternately, such tubes may be used to pick up balls and placed on apparatus 10 to be used when desired.

As discussed, apparatus 10 also includes ball retention and discharge means 30 for retaining one ball 11 until another is released and subsequently releasing the retained ball. In the exemplary embodiment of the invention, as particularly shown in FIG. 3, ball outlet 28 includes an opening such as a slot 31 in its lower portion for receiving therein an abutting lip portion 32 of gate means in the preferred form of a movable release plate 33. Release plate 33 is pivotally secured, via pivot pin 34, in a housing 35 (see particularly FIG. 3). Housing 35 is formed of a pair of spaced members 38, 39 between which plate 33 is movable. Members 38, 39 are secured at their lower ends via suitable nuts and bolts 40 to body portion 12.

Figure 2:
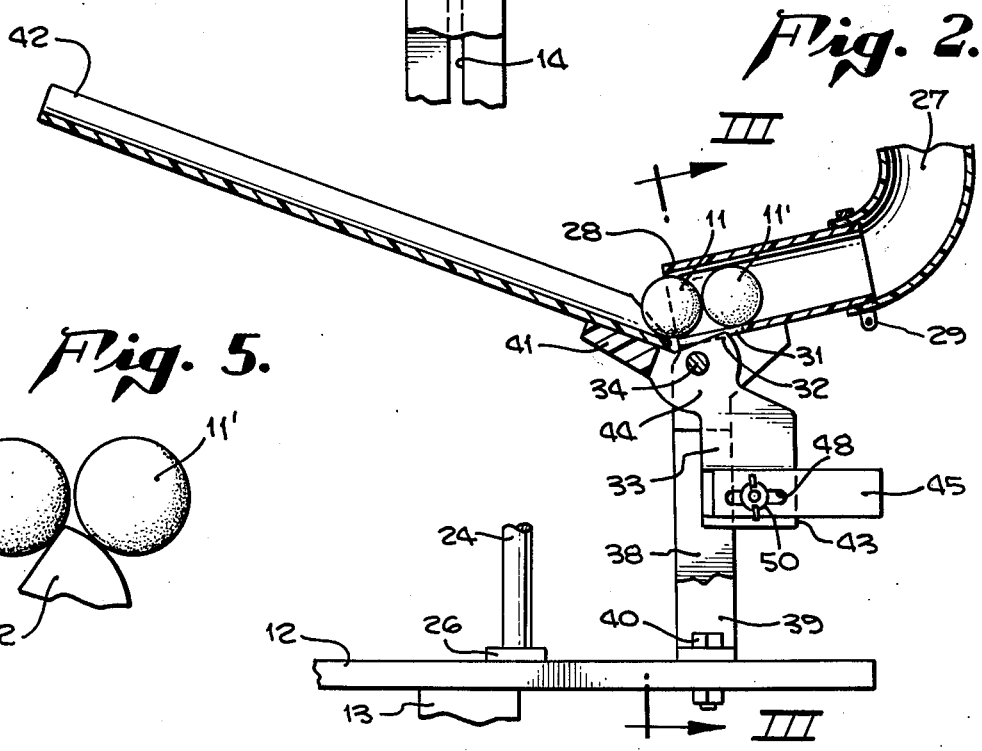
FIG. 2 is a vertical, partly sectional, view of a portion of the apparatus of FIG. 1.
Figure 3:
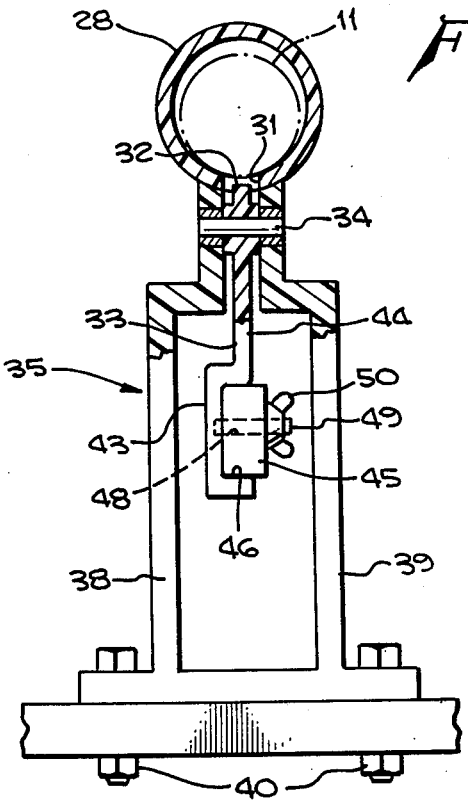
FIG. 3 is a view, partly sectional, taken along the lines III—III of FIG. 2.

As shown in FIGS. 1 and 2, plate 33 includes an extension portion 41 which extends away from ball outlet 28 and under an elongated member such as a ball track 42 and is fixedly secured thereto. Plate 33 also includes a downwardly extending portion 43 which is offset from the plane of the upper body portion 44 of plate 33 as shown particularly in FIG. 3. Counterweight means such as a weighted member 45 may be movable within the space 46 formed by the offsetting of portion 43, the counterweight means being movable in the spacing between members 38, 39 as shown in FIG. 3. Weighted member 45 may have a slot 48 therein for receiving a screw 49 therethrough. Screw 49 extends through a suitable aperture in offset portion 43, and a wing nut 50 fixedly and adjustably secures weighted member 45 within the space 46. As discussed, and as shown in FIG. 1, lip portion 32 is movable upwardly within slot 31 and acts as a stop for balls 11. As shown in FIG. 1, lip portion 32 may be curved at the point of engagement with ball 11 as shown. Thus, track 42, weighted member 45 and lip portion 32 act as weighted stop means for balls 11 as will be discussed.

Figure 4:
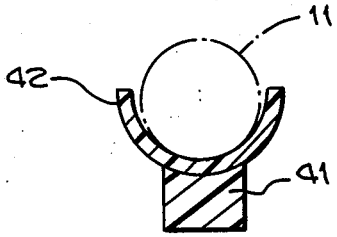
FIG. 4 is a view taken along the lines IV—IV of FIG. 1.

Track 42 is preferably elongated and, as shown in FIG. 4, generally semi-circular in cross-section. The inner diameter of track 42 is preferably related to the outer diameter of balls 11 so that the balls roll down track 42, guided by the curved wall of track 42. As shown in FIG. 1, track 42 is downwardly inclined so that, except for lip portion 32, balls inserted in tube 21 would roll or move by gravity through tube 21, past elbow portion 27, and down track 42.

As particularly contemplated in the present invention, limiting means 60 are provided on base portion 12 for stopping or limiting the downward extent of track 42. In the exemplary embodiment, limiting means 60 includes a generally vertically upstanding plate 61 fixedly secured at the end of base portion 12 adjacent the terminal end of track 42. A second plate 62 is vertically adjustably and fixedly secured to first plate 61 by providing a slot 63 in plate 62 for receiving therein a screw 64 extending through a suitable aperture in plate 61. A wing nut 65 retains the two plates 61, 62 in fixed, adjustable relationship. The upper surface of plate 62 that is adapted to abut against track 42 may be curved or configured similarly to track 42 as at cut-out portion 66.

Any suitable materials, such as light weight plastic, wood, metal, etc., may be used in apparatus 10.

Figure 5:
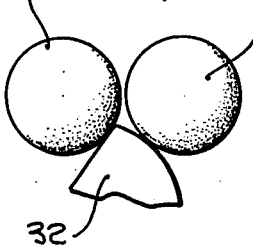
FIG. 5 is a detailed view illustrating one position of a portion of the apparatus of FIG. 1 during operation.

In operation, tube 21, with balls 11 therein, is clamped in position shown in FIG. 1 onto elbow portion 27. Balls 11 roll down to outlet 28 and have their descent stopped by lip portion 32. When it is desired to start the delivery of balls 11 down track 42 in a one-at-a-time relationship, track 42 may be manually lifted upwardly, as shown in FIG. 2. Since plate 33 is fixed to track 42 by means of extension portion 41, plate 33 also moves to the position shown in FIG. 2. Since lip portion 32 also moves in a clockwise direction, the first ball 11 rolls over lip portion 32 and is retained at the junction of track 42 and ball outlet 28, as shown in FIG. 2. The first ball 11 prevents the second ball 11' (FIG. 2) from also moving past lip portion 32 due to the position of track 42. When track 42 is released, the weight of first ball 11 on track 42 moves the track 42 downwardly towards the FIG. 1 position. As shown in FIG. 5, lip portion 32 moves to a position between first ball 11 and second ball 11' thus preventing two balls from moving down track 42 at the same time. When the first ball 11 leaves track 42, as shown in FIG. 1, the weighted member 45 moves in a clockwise direction to the FIG. 2 position thus releasing a subsequent ball. This is repeated until all of the balls 11 move off of track 42.

As discussed, the angle of tube 21 can be adjusted to provide gravity discharge of the balls. The overall height of apparatus 10 can be adjusted as discussed to have balls 11 either bounce to a desired level or released at a desired level. Weighted member 45 may be adjusted to provide for proper operation of the cycling of the balls 11. The overall height of plate 62 may be adjusted which would increase or decrease the interval between balls.

Figure 6:
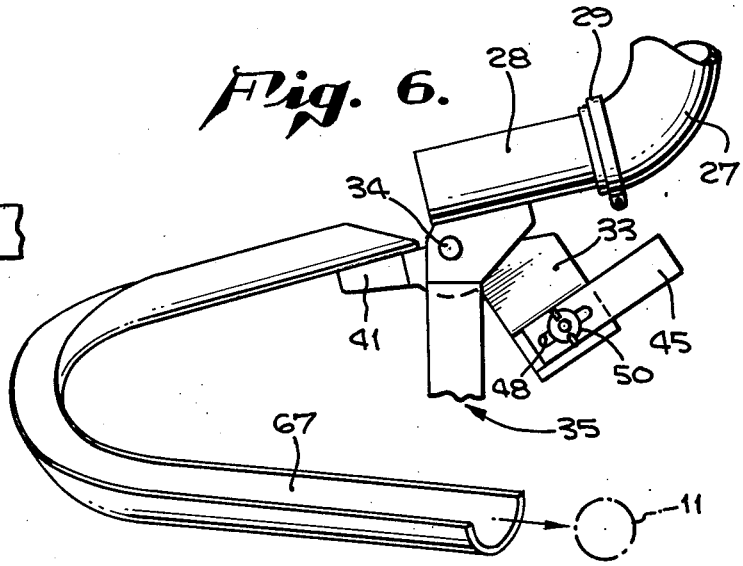
FIG. 6 is a vertical view of a portion of the apparatus of FIG. 1 showing a first modification of the track thereof.

Although an elongated track 42 has been described, any suitable configuration may be provided such as the spiral-shaped track 67 shown in FIG. 6 wherein like elements refer to like parts of the embodiment of FIGS. 1 through 5. It will be appreciated that, in all embodiments, the overall length and shape of the discharge track would obviously vary the time between delivery of the balls and the rate of speed at which they are delivered.

Figure 7:
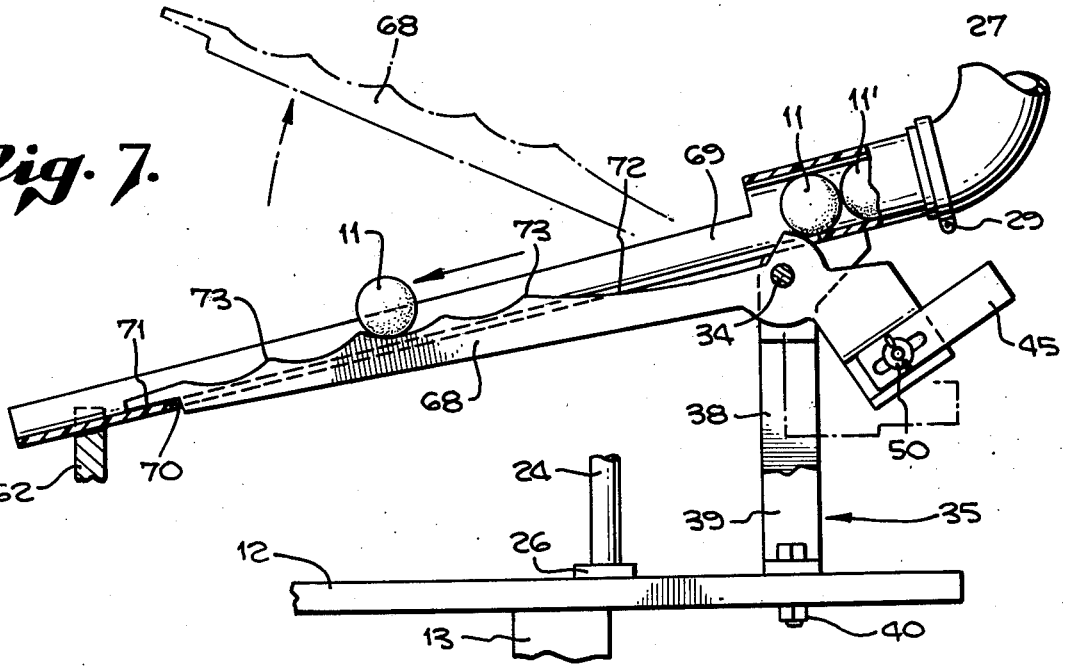
FIG. 7 is a vertical, partly sectional, view of a portion of the apparatus of FIG. 1 showing a second modification of the track thereof.

Although tracks have been described in FIGS. 1 through 6 which are fixed to the plate 33, as shown in FIG. 7, wherein like numerals refer to like parts of the embodiment of FIGS. 1 through 5, in place of extension portion 41, an elongated member 68 may be provided integral with plate 33. In place of track 42, a fixed track 69 may be provided which may be an integral extension of ball outlet 28. Track 69 may be slotted at slot 70 for receiving therein a track portion in the form of an elongated member 68. Elongated member 68 may include a shoulder portion 71 which is adapted to abut against track 69 to stop its downward descent. The upper surface 72 of member 68 may have ball slow-down means in the preferred form of a plurality of spaced bumps 73 or the like which act to slow down balls 11 on their downward descent. The operation of member 68, as indicated by the dotted lines in FIG. 7, is identical to that of the track of FIGS. 1 through 6.

It can be seen therefore that we have disclosed apparatus which can utilize the pickup tubes used to pick up balls such as tennis balls and that such tubes can be quickly and easily inserted on the apparatus 10. Although a flexible elbow portion 27 has been disclosed, obviously other materials may be used such as flexible ductage material or the like. The separation between the balls that are discharged out of apparatus 10 may be quickly and easily adjusted by raising and lowering the stop means 60 to increase or decrease the slope of the track. The overall height of the apparatus may be adjusted as disclosed and the apparatus may be mounted on a suitable base, either mobile or stationary. Although the apparatus has been disclosed as particularly suited for use in the practice of tennis, the tube 21 may also be used to contain other balls such as baseballs, golf balls, table tennis balls, etc. The tube 21 may be adjustable in height and the entire apparatus may be adjusted to discharge balls at any desired intervals such as one to five seconds between each ball. The balls may be adjusted so that they drop from the apparatus to a surface, such as the ground, from any desired height such as 3 to 6 feet. If tennis balls were being used, for example, and the balls were dropped from a 3 to 6 foot height, they would rebound into the air 2 to 2½ feet after hitting the ground thus allowing the practicing tennis player to hit each ball and practice his strokes. The player would stand slightly to the side of the apparatus and stroke the ball after it has hit the ground and bounced up. Alternatively, he could hit the balls as they fall towards the ground. The delivery of the balls is solely actuated by gravity and requires no external motive force or any other type of energy source. Such apparatus has particular advantages over known prior art ball throwing or discharging machines. In addition to gravity being the only source of power used, apparatus 10, and the various modifications, is low in cost, has relatively few parts, and requires minimum maintenance and operating costs, is low in bulk and weight, and is completely portable.

The lip portion 32 on plates 33 acts as a gate to prevent each ball from rolling out of the exhaust tube or ball outlet 28 until a preceding ball rolls down the track and the lip portion is lowered below the internal wall of the ball outlet 28. The sloped or curved portion of lip portion 32 thus acts to prevent a subsequent ball from rolling out of the ball outlet 28 until it is released. Although the balls being discharged from apparatus 10 have been described as being adapted to fall from a height and bounce on a surface, the length and height and shape of the tracks of the various embodiments may be adjusted so that the balls are in effect thrown off of the track for practice hitting by a player, such as a baseball player. Although the tube 21 has been described as being essentially linear and tubular, it may be any desired configuration but preferably as described so that it may utilize known ball pickup tubes. For example, tube 21 may be spirally shaped. The weighted member 45 acts as a counterweight and causes the plate 33, with its protruding lip portion 32, to return to its rest position. Obviously, as disclosed, the position of this weighted member 45 may be adjusted to provide for maximum efficient operation of the device. The positioning of this weighted member 45 would depend of course in part on the weight of the balls being used. Although specific type of adjusting means for the weighted member 45 and the various heights of the portions of apparatus 10 have been described, obviously other relationships for providing adjustability may be provided, such as sliding weights, telescoping members, etc. Of course, if the spirally shaped track 67 of FIG. 6 is used, the balls would be discharged at a differing location than in the apparatus of FIG. 1. The time interval between the balls is thus controlled by the length of the various tracks or the elongated member 68 of FIG. 7, the slope of the tracks of FIGS. 1 and 6 and the number and configuration of the bumps 73 of the member 68 of FIG. 7. Of course, other factors, such as the position of the sliding weight 45, the various heights of the differing elements, may also affect the separation time between the balls.

Figure 8:
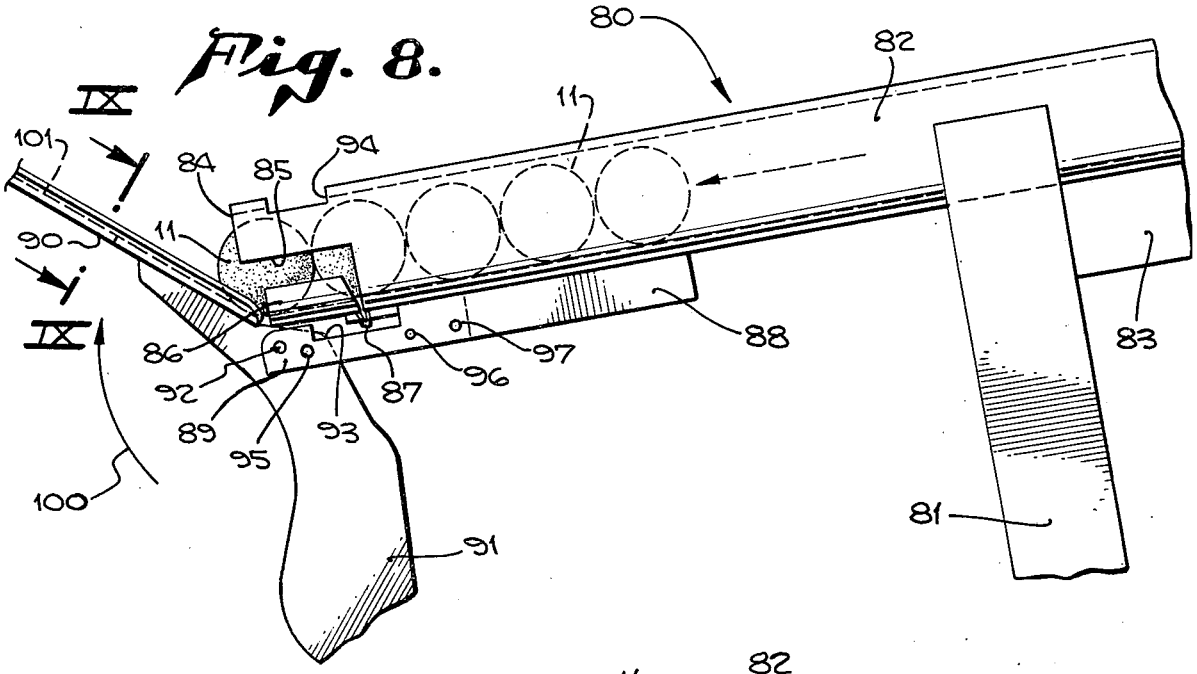
FIG. 8 is vertical view of a portion of an alternate embodiment of the invention in the ball loading position.

As shown in FIG. 8, an alternate embodiment of apparatus is shown for conveying a plurality of tennis balls, one after another to a desired location for striking by a player. Thus, in FIGS. 8 through 11, portions being omitted for convenience of illustration since such omitted portions are identical to that of apparatus 10 of FIG. 1, apparatus 80 is shown having a support 81 which may be secured to base portion 12 as in FIG. 1. Gravity feed ball supply means is provided in the form of a tubular elongated ball delivery tube 82, which may be transparent, the upper portion of support 81 being curved (as curved support 22 of FIG. 1) for receiving supporting tube 82. A bracket 83 may interconnect support 81 to a similar support (not shown) coupled to tube 82 in like manner, both supports being secured to a base portion 12 as in FIG. 1.

The lower end of tube 82 terminates in an open ball outlet 84, this portion of tube 82 being cut away to form a widened slot 85 that is arcuate in cross-section. Ball retention and discharge means is provided including a gating flap 86 mounted within slot 85 and having the same contour as tube 82. Flap 86 is pivotally secured to tube 82 by hinge 87, for example, with the inner surface of flap 86 lying flush with the inner surface of tube 82. Flap 86 is smaller than slot 85 in both length and width so that it can move upwardly within the slot 85 in the manner discussed below.

A support member 88 is secured to the underside of tube 82 and terminates at outlet 84 in a yoked end 89. A ball track 90 is fixedly secured to a counterweight 91 which is pivotally mounted within yoke 89 by a pivot pin 92. As shown more fully in FIG. 9, ball track 90 may be slightly arcuate in cross-section and have a cut-out slot 101 (dotted lines of FIG. 8) along a substantial portion of its length (see also ball 11 in FIG. 11) to assist in discharging tennis balls from apparatus 80 as well as to reduce the adverse effect of wind resistance on the movement of the track 90. Preferably, the width of the slot 101 is made equal to about ¾ of the diameter of the balls 11 being delivered. However, it should be understood that the slot width may be varied in a desired manner to control the velocity of the balls 11 as they travel down the track 90.

It is to be understood that counterweight 91 may include the adjusting components 45, 46, 48 and 50 of FIG. 1 so as to be able to adjust the counterweight thereof as previously disclosed.

An abutting lip or cam portion 93 is provided between counterweight 91 and track 90, cam portion 93 being disposed within the yoke 89. As shown in FIG. 8, flap 86 is flush with the lower surface of tube 82 and track 90 is in the "up" position, thereby preventing the first tennis ball 11 from being discharged out of apparatus 80.

A slot 94 may be provided above slot 85 in tube 82 to provide a relief portion or opening for tennis balls as apparatus 80 is actuated, as will be discussed. A stop pin 95 may be provided through suitable aligned apertures in counterweight 91 and yoke portion 89 which may be used to retain track 90 in the FIG. 8 position until actuation thereof is desired.

A further stop pin 96 may be provided extending through a suitable aperture in support member 88. It is to be understood that counterweight 91 will abut against pin 96 to stop pivotal movement thereof (see FIG. 11). By providing one or more apertures, such as aperture 97, pin 96 may be moved to thus vary the time between delivery of tennis balls.

Figure 10:
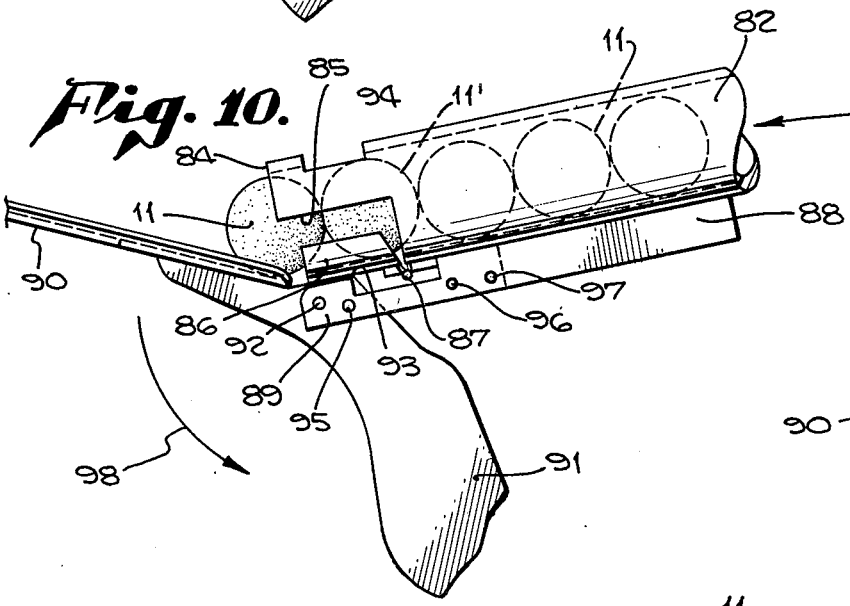
FIG. 10 is a view similar to FIG. 8 showing the apparatus in the initial ball release position.
Figure 9:
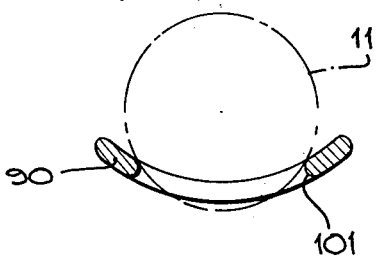
FIG. 9 is a view taken along lines IX—IX of the track of the apparatus of FIG. 8.
Figure 11:
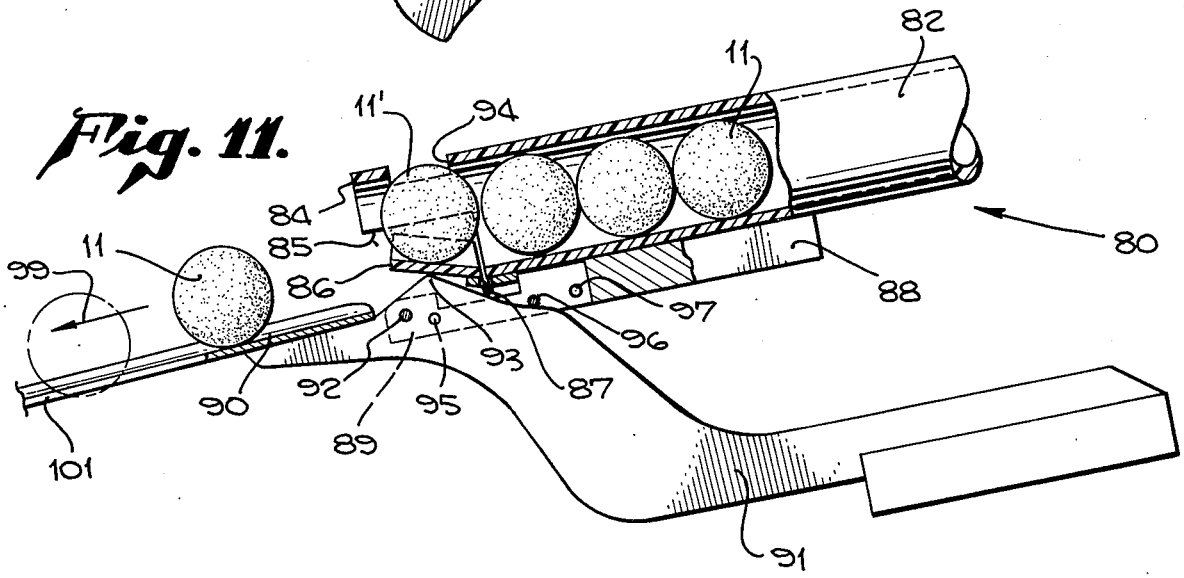
FIG. 11 is another view similar to FIG. 8 illustrating the apparatus in the full release and subsequent ball blocking position.

By removing pin 95, track 90 moves downwardly in the direction of arrow 98 in FIG. 10. Cam portion 93 moves into abutting engagement with the underside of flap 86 as the first tennis ball 11 rolls onto track 90. As track 90 continues to move downwardly in FIG. 10, flap 86 is moved upwardly by cam portion 93 (see FIG. 11), thus holding back a subsequent tennis ball 11' while permitting the released tennis ball 11 to roll down track 90 in the direction of arrow 99 (FIG. 11). It is further pointed out that because the flap 86 terminates inwardly of the end of the tube 82, the exiting ball 11 can exert immediate downward force against the track 90, and as the ball 11 moves onto the track 90, the flap 86 can more rapidly commence its upward movement to a restraining position. Slot 94 in tube 82 permits the upper surface of ball 11' to move therein to prevent possible jamming of balls within the tube 82.

After release of ball 11 from track 90, as heretofore discussed, track 90 moves upwardly in the direction of arrow 100 in FIG. 8. Simultaneously, cam portion 93 and thus flap 86 move back to the FIG. 8 position, with the track 90 abutting against a subsequent tennis ball as in FIG. 8. This cycle of operation will continue until all balls are discharged one at a time from tube 82.

As shown in FIG. 8, the location of pivot pin 92 is to the left of the cam portion 93 and directly under the ball engaged by the track 90 and about to be released. As shown in FIG. 10, the location of cam portion 93 is approximately between the ball about to be released and the next ball 11' in tube 82 so that the flap 86 can be moved to a position restraining the ball 11' and all the remaining balls in the tube 82.

It can be seen that, after a ball has exited from track 90, the pressure of the remaining balls in tube 82 tends to open flap portion 86, thus eliminating jamming. Tennis balls may vary slightly in diameter, degree of fuzziness, weight, etc. between differing manufacturers. Further, as such balls wear in use, the fuzz wears off thereby varying their conformation. The apparatus disclosed herein compensates for varying weight of stored tennis balls. No delicate adjustment is required to enable each embodiment to work with a single tennis ball. Time intervals may be controlled between ball deliveries by varying the length and slope of the track and, in the FIG. 8 embodiment, by moving pin 96 to aperture 97 (or other apertures). For example, pin 96 as shown may provide a 3.5 second interval between balls and, in aperture 97, a 3 second interval.

There are thus disclosed various embodiments of apparatus for delivering tennis balls one at a time to a desired location in a quick, efficient and relatively inexpensive manner without jamming or the like.

I claim:

1. Apparatus for delivering a plurality of balls one after another to a desired location with a predetermined time interval therebetween comprising:

a support;

ball supply means carried by said support for feeding a plurality of balls by gravity to a ball discharge region; and pivotally mounted, gravity operated ball retention and discharge means operatively associated with said ball supply means for both retaining a ball fed by gravity to said ball discharge region until a ball is discharged by gravity from said ball discharge region and releasing a ball by gravity to a desired location while a subsequent ball and all remaining balls in said supply means are being prevented from discharge from said ball discharge region, said ball retention and discharge means including ball separation and control means moveable between a first position engaging a first ball in said discharge region and a second position releasing said first ball from said discharge region, while enabling the next ball to enter said discharge region and retaining said next ball and all remaining balls in said supply means;

said ball separation and control means including a counterweight portion, an elongated track portion of a predetermined length and a cam portion between said track and said counterweight portions, said cam portion being pivotally mounted about a location beneath said ball discharge region and being moveable between a retracted position when said separation and control means is in said first position and an elevated position protruding into said ball discharge region between said first ball and said next ball when said separation and control means is in said second position, said second position being such that said track portion slopes downwardly from said discharge region at a predetermined angle, whereby said first ball upon release from said discharge region travels down said track portion to gradually overcome the weight of said counterweight portion and drive said separation and control means into said second position, and upon release from said track portion enables said counterweight portion to return said separation and control means to said first position, said predetermined length and said predetermined angle being preselected to allow successive balls to be released from said track portion with said predetermined time interval therebetween;

said ball retention and discharge means including a ball outlet operatively connected to said ball supply means, said ball outlet being a stationary elongated generally linear track generally semi-circular in cross-section and having a slot therein, said slot extending substantially the entire length of said track and receiving said cam portion, said track portion being moveable within said slot at a location remote from where said cam portion moves into said slot and away from said ball supply means, and said track portion having ball slow-down means on its upper surface adapted to slow down a ball traveling therealong.

2. The apparatus of claim 1 wherein said ball slow-down means includes a plurality of spaced bumps on the upper surface of said track portion.

3. Apparatus for delivering a plurality of balls one after another to a desired location with a predetermined time interval therebetween comprising:

a support;

an inclined ball supply tube carried by said support and having an open lower end for feeding a plurality of balls by gravity to a ball discharge region within said tube adjacent to said lower end, the lower lateral surface of said ball supply tube defining an opening at said ball discharge region; and pivotally mounted, gravity operated ball retention and discharge means operatively associated with said ball supply tube for both retaining a ball fed by gravity to said ball discharge region until a ball is discharged by gravity from said ball discharge region and releasing a ball therefrom by gravity while a subsequent ball and all remaining balls in said supply tube are being prevented from discharge from said ball discharge region;

said ball retention and discharge means including a ball gating flap disposed in said opening in said supply tube and having its end remote from said open lower end of said supply tube pivotally attached to said supply tube, said flap being moveable between a ball-restraining position wherein its free end protrudes into said supply tube and a non-restraining position wherein its surface facing the interior of said supply tube lies substantially flush with the inner lateral surface of said supply tube, said surface of said flap having a shape to permit unrestrained ball movement therealong by gravity when said flap is in said non-restraining position;

said ball retention and discharge means further including an elongated counterweighted member pivotally mounted at a location immediately beneath said discharge region; said counterweighted member including an elongated track portion of predetermined length on the side of said location nearer to said open end of said supply tube, a counterweight portion on the opposite side of said location, and an intermediate cam portion adjacent to said location and extending upwardly into contact with said gating flap, said track portion being disposed to form a ball track in substantial continuity with said ball supply tube;

said counterweighted member being moveable between a first position wherein said cam portion permits said gating flap to assume said non-restraining position while said track portion engages a first ball at said open end of said supply tube with sufficient upward slope from said discharge region to block release of said first ball, and a second position wherein said track portion slopes downwardly from said discharge region at a predetermined angle permitting release of said first ball while said cam portion urges said gating flap to said ball-restraining position to retain the next ball and all remaining balls in said supply tube, whereby said first ball upon release from said discharge region travels down said track portion to gradually overcome the weight of said counterweight portion and drive said counterweighted member into said second position, and upon release from said track portion enables said counterweighted member to return to said first position, said predetermined length and said predetermined angle being preselected to allow successive balls to be released from said track portion with said predetermined time interval therebetween.

4. The apparatus of claim 3 wherein said track portion has a curved cross-section and defines an elongated slot along a substantial portion of its length.

5. The apparatus of claim 4 wherein said slot has a width equal to about ¾ of the diameter of balls being processed.

6. The apparatus of claim 3 wherein said supply tube includes a further opening therein above said gating flap for receiving the ball about to be discharged from said discharge region to prevent jamming of balls in said supply tube.

7. The apparatus of claim 3 and further including moveable limit means engageable with different areas of said cam portion for limiting the upward movement of said cam portion accordingly and hence the maximum angle at which said track portion slopes downwardly, thereby controlling said predetermined time interval between successively released balls.

* * * * *